United States Patent [19]

Abe et al.

[11] Patent Number: 4,709,334

[45] Date of Patent: Nov. 24, 1987

[54] METHOD FOR CONTROLLING THE SUPPLY OF FUEL FOR AN INTERNAL COMBUSTION ENGINE

[75] Inventors: Yoshiharu Abe, Tochigi; Yoshio Wazaki; Tetsuya Oono, both of Utsunomiya, all of Japan

[73] Assignee: Honda Giken Kogyo Kabushiki Kaisha, Japan

[21] Appl. No.: 781,053

[22] Filed: Sep. 27, 1985

[30] Foreign Application Priority Data

Sep. 28, 1984 [JP] Japan ..... 59-203274

[51] Int. Cl.[4] ..... F02D 5/02; F02M 51/00

[52] U.S. Cl. ..... 364/431.05; 123/494; 123/480; 364/431.07

[58] Field of Search ..... 364/431.05, 431.07; 123/339, 494, 480

[56] References Cited

U.S. PATENT DOCUMENTS 4,155,332 5/1979 Yaegashi et al. ..... 123/494

4,319,327 3/1982 Higashiyama et al. ..... 364/431.05

4,561,404 12/1985 Kanno et al. ..... 123/494

4,571,683 2/1986 Kobayashi et al. ..... 364/431.05

4,597,368 7/1986 Ament ..... 123/339

4,604,703 8/1986 Hasegawa ..... 123/339

*Primary Examiner*—Parshotam S. Lall

*Attorney, Agent, or Firm*—Birch, Stewart, Kolasch & Birch

[57] ABSTRACT

A method for controlling the fuel supply of an internal combustion engine determines the fuel supply amount on the basis of sampled values of a pressure level within an intake pipe of the engine when the engine is operating outside of an idling range, and determines the fuel supply amount on the basis of sampled values of rotational speed of the engine when a predetermined time period has passed after the entrance of the engine operation into the idling range, and an idling speed of the engine is stabilized. Thus, a change in the engine rotational speed upon the start of idling which has been occurred in the prior art is eliminated.

6 Claims, 7 Drawing Figures

METHOD FOR CONTROLLING THE SUPPLY OF FUEL FOR AN INTERNAL COMBUSTION ENGINE

BACKGROUND OF THE INVENTION

1. Field of the Invention.

The present invention relates to a method for controlling the supply of fuel for an internal combustion engine.

2. Description of Background Information

Among internal combustion engines for a motor vehicle, there is a type in which fuel is supplied to the engine via a fuel injector or fuel injectors.

As an example, there are systems in which the pressure within the intake pipe downstream of the throttle valve, and the engine rotational speed (referred to as rpm (revolutions per minute) hereinafter) are sensed and a basic fuel injection time $T_i$ is determined according to the result of the detection at predetermined intervals synchronized with the engine rotation. The basic fuel injection time $T_i$ is then multiplied with a correction coefficient determined according to engine parameters such as the engine coolant temperature or a transitional change in the engine operation. In this manner, an actual fuel injection time $T_{out}$ corresponding to the required amount of fuel injection is calculated.

However, in this arrangement, there is inevitably a delay of control operation between a time of detection of the pressure within the intake manifold and a time of actual fuel injection. This means that the pressure in the intake manifold at the time of actual fuel injection may greately differ from the detected pressure especially when the pressure change in the intake manifold is relatively large, such as in the case of the acceleration of the engine. Therefore, a control method was proposed and described in Japanese Patent Application No. 59-104315 which was assigned to the same assignee of the present application. In this control method, the pressure in the intake manifold at the time of actual fuel injection is estimated, for example, from a manner of variation of the detected value of the pressure in the intake manifold. The amount of the basic fuel injection is determined in accordance with the estimated value of the pressure in the intake manifold.

However, during idling of the engine, the opening degree of the throttle valve is small and substantially constant. Therefore, the pressure in the intake manifold does not follow the change in the engine rotational speed especially in the case where the capacity of the intake manifold is relatively large. Therefore, the amount of the fuel injection can not be determined appropriately even though an estimation of the pressure in the intake manifold at the time of the fuel injection is performed.

In order to solve this problem, a technique is proposed in which the engine rotational speed at the time of fuel injection is estimated and the basic fuel injection amount is corrected according to the estimated value of the engine rotational speed.

In this type of method for controlling fuel supply, it is general to detect an idling range of the engine in terms of the pressure within the intake manifold and the engine rotational speed. Specifically, the idling of the engine is detected as a state in which the engine rotational speed is lower than an idling reference speed of the engine, and an absolute pressure of the intake air in the intake manifold is lower than a reference pressure for detecting the idling of the engine. The idling reference speed is set at a level slightly higher than a stable rotational speed at which the engine rotational speed becomes stable during a no-load condition of the engine after the warming-up of the engine. Also, the reference pressure is determined at an absolute pressure level which is slightly higher than an absolute pressure of the intake air which is obtained when the engine is operating at the stable rotational speed mentioned above. This is because, in the case of an engine mounted on a vehicle, the rotational speed of the engine is raised during a period in which the engine is idling while an air conditionar of the vehicle is operated.

However, if the operating condition of the engine falls in the thus defined idling range of the engine operation while the engine is decelerating, the amount of fuel supply may be changed discontinously because the method of calculation of the fuel supply amount is different between inside and outside of the idling range of the engine. This may result in a sensible change in the engine speed which causes a shock being felt by a driver or a passenger of the vehicle.

OBJECT AND SUMMARY OF THE INVENTION

An object of the present invention is therefore to provide a method for controlling the fuel supply of an internal combustion engine in which the change in the engine speed at the time of switching of the method of calculation of the fuel supply amount is minimized to reduce the shock caused by the change in the engine speed.

According to the present invention, the method for controlling the supply of fuel is characterized in that the switching of the manner of calculation of the amount of the fuel supply is inhibited for a predetermined time period after a detection of the engine operation in the idling range, until the operation of the engine under the idling state becomes stable.

DETAILED DESCRIPTION OF THE PREFERRED EMBODIMENT

Figure 1:
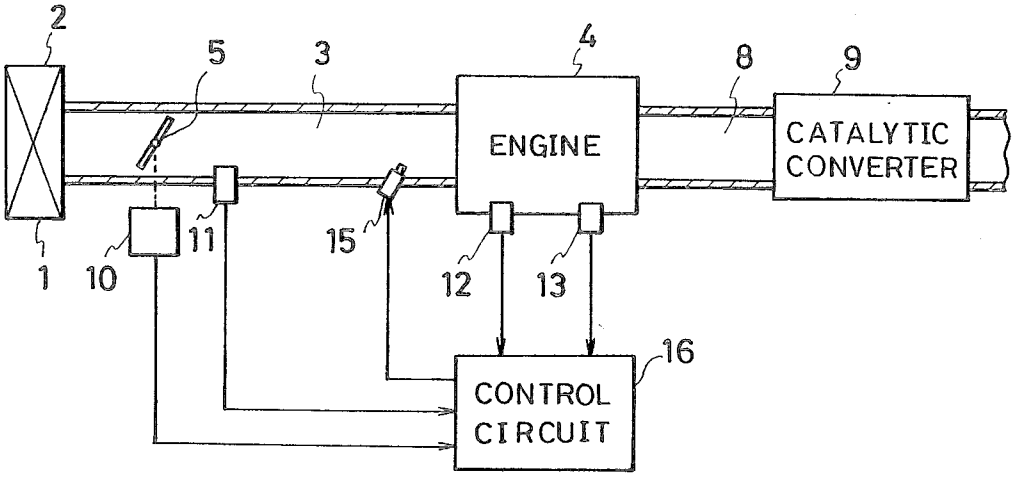
FIG. 1 is a schematic structural illustration of an electronically controlled fuel supply system in which the fuel supply control method according to the present invention is applied.

Reference is first made to FIG. 1 showing a schematic illustration of an internal combustion engine which is provided with an electronic fuel supply control system operated in accordance with the controlling method according to the present invention. In FIG. 1, an engine designated at 4 is supplied with intake air taken at an air intake port 1 and which passes through an air cleaner 2 and an intake air passage 3. A throttle valve 5 is disposed in the intake air passage 3 so that the amount of the air taken into the engine is controlled by its opening degree. The engine 4 has an exhaust gas passage 8 with a three-way catalytic converter 9 for effecting the reduction of noxious components such as CO, HC, and NOx in the exhaust gas of the engine.

Further, there is provided a throttle opening sensor 10, consisting of a potentiometer for example, which generates an output signal whose level correspondes to the opening degree of the throttle valve 5. Similarly, in the intake air passage 3 on the downstream side of the throttle valve 5, there is provided an absolute pressure sensor 11 which generates an output signal whose level correspondes to an absolute pressure within the intake air passage 3. The engine 4 is also provided with an engine coolant temperature sensor 12 which generates an output signal whose level corresponds to the temperature of the engine coolant, and a crank angle sensor 13 which generates a pulse train in accordance with the rotation of a crankshaft (not illustrated) of the engine 4. The crank angle sensor 13 is for example constructed so that a pulse signal is produced every 180° revolution of the crankshaft in the case of a four cylinder engine. For supplying the fuel, an injector 15 is provided in the intake air passage 3 adjacent to each inlet valve (not shown) of the engine 4.

Output signals of the throttle opening sensor 10, the absolute pressure sensor 11, the engine coolant temperature sensor 12, the crank angle sensor 13 are connected to a control circuit 16 to which an input terminal of the fuel injector 15 is also connected.

Figure 2:
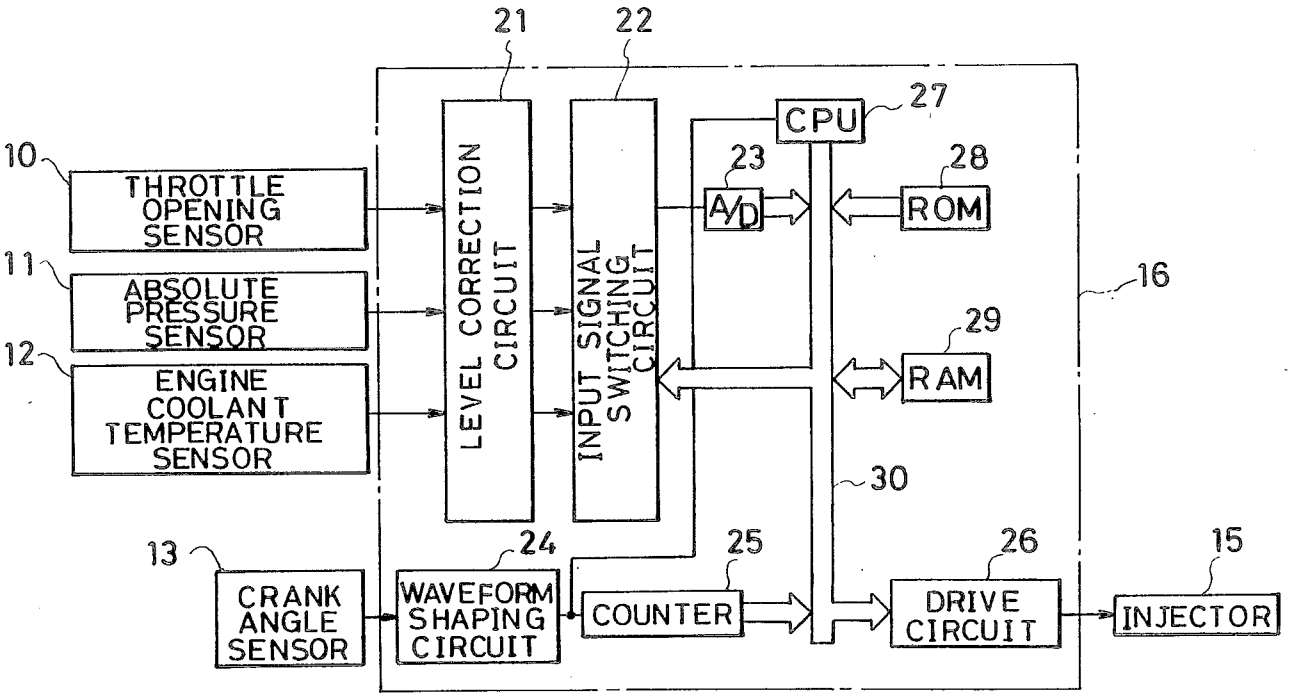
FIG. 2 is a block diagram showing a concrete circuit construction of the control circuit used in the system of FIG. 1.

Referring to FIG. 2, the construction of the control circuit 16 will be explained. The control circuit 16 includes a level correction circuit 21 for adjusting the level of the output signals of the throttle opening sensor 10, the absolute pressure sensor 11, the coolant temperature sensor 12. These output signals whose level is adjusted by the level correction circuit 21 are then applied to an ihput signal switching circuit 22 in which one of the input signals is selected and in turn output to an A/D (Analog to Digital) converter 23 which converts the input signal supplied in analog form to a digital signal. The output signal of the crank angle sensor 13 is applied to a waveform shaping circuit 24 which effects the waveform shaping of the input signal and provides a TDC (Top Dead Center) signal according to the output signal of the crank angle sensor 13. A counter 25 is provided for measuring the time interval between each pulses of the TDC signal. The counter 25 is, for instance, constructed to count the number of clock pulses having predetermined frequency. The clock pulses are supplied from a predetermined clock pulse generator. The control circuit 16 further includes a drive circuit 26 for driving the injector 15, a CPU (Central Processing Unit) 27 for performing the arithmetic operation in accordance with programs stored in a ROM (Read Only Memory) 28 also provided in the control circuit 16, and a RAM (Random Access Memory) 29. The input signal switching circuit 22, the A/D converter 23, the counter 25, the drive circuit 26, the CPU 27, the ROM 28, and the RAM 29 are mutually connected by means of an input/output bus 30. The TDC signal from the waveform shaping circuit 24 is also supplied to the CPU 27.

With this circuit construction, information of the throttle opening degree $\theta_{th}$, absolute value of the intake air pressure $P_{BA}$, and the engine coolant temperature $T_W$ are alternatively supplied to the CPU 27 via the input/output bus 30. From the counter 25, information of the count value $M_e$ indicative of an inverse number of the engine revolution $N_e$ is supplied to the CPU 27 via the input/output bus 30. In the ROM 28, various operation programs for the CPU 27 and various data are stored previously.

In accordance with this operation programs, the CPU 27 reads the above mentioned various information and calculates the fuel injection time of the fuel injector 15 corresponding to the amount of fuel to be supplied to the engine 4, using a predetermined calculation formulas in accordance with the information read by the CPU 27. During the thus calculated fuel injection time period, the drive circuit 26 actuates the injector 15 so that the fuel is supplied to the engine 4.

Figure 3:
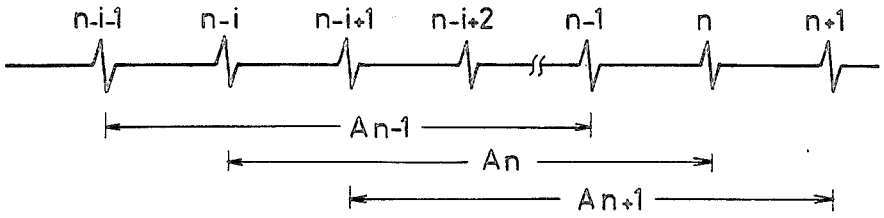
FIG. 3 is a diagram illustrating an operation of the counter 25 of FIG. 2.

Referring to FIG. 3, the operation of the counter 25 will be explained. In FIG. 3, the TDC signal is illustrated as intermittent pulses each are designated at "n−i−1", "n−i", and so on in which "i" denotes the cylinder number of the engine. Each of these pulses of TDC signal will be referred to as "n−i−1th TDC signal", "n−ith TDC signal", and so on. When an nth TDC signal is supplied to the counter 25, it provides a result of counting of clock pulses during a period $A_n$ starting from a point of time at which an n−ith TDC signal is generated and ending at a point of time at which nth TDC signal is generated. Similarly, when an n+1th TDC signal is supplied, the counter 25 produces a result of counting during a period $A_{n+1}$ starting from a point of time at which an n−i+1th TDC signal is generated to a point of time at which n+1th TDC signal is generated. In this way, a period of one four-stroke cycle (including the intake stroke, the compression stroke, the power stroke, and the exhaust stroke) is counted for each cylinder.

Figure 4A:
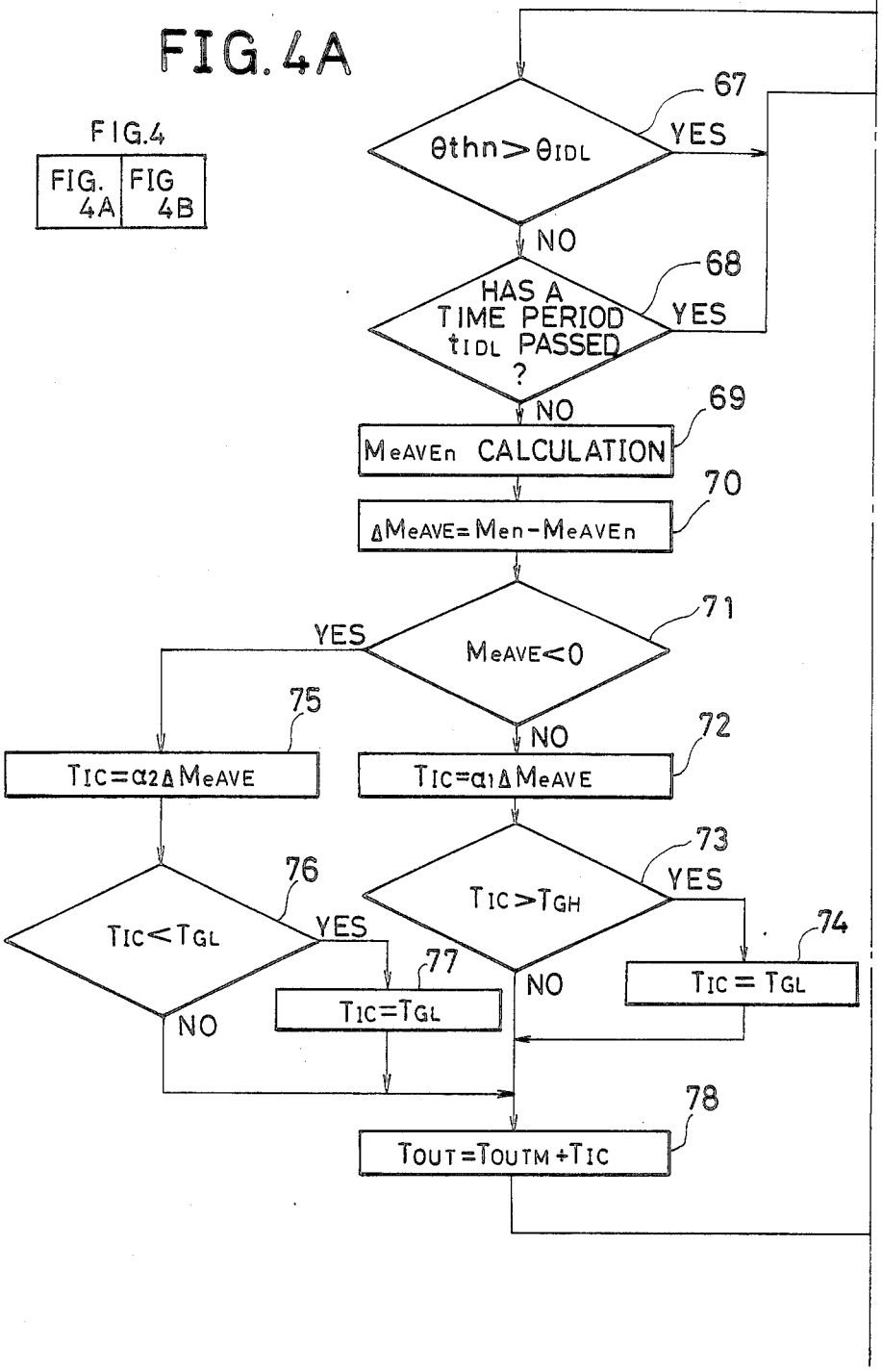
FIGS. 4A and 4B, when combined, are a flowchart showing the operation of an embodiment of the present invention.
Figure 4B:
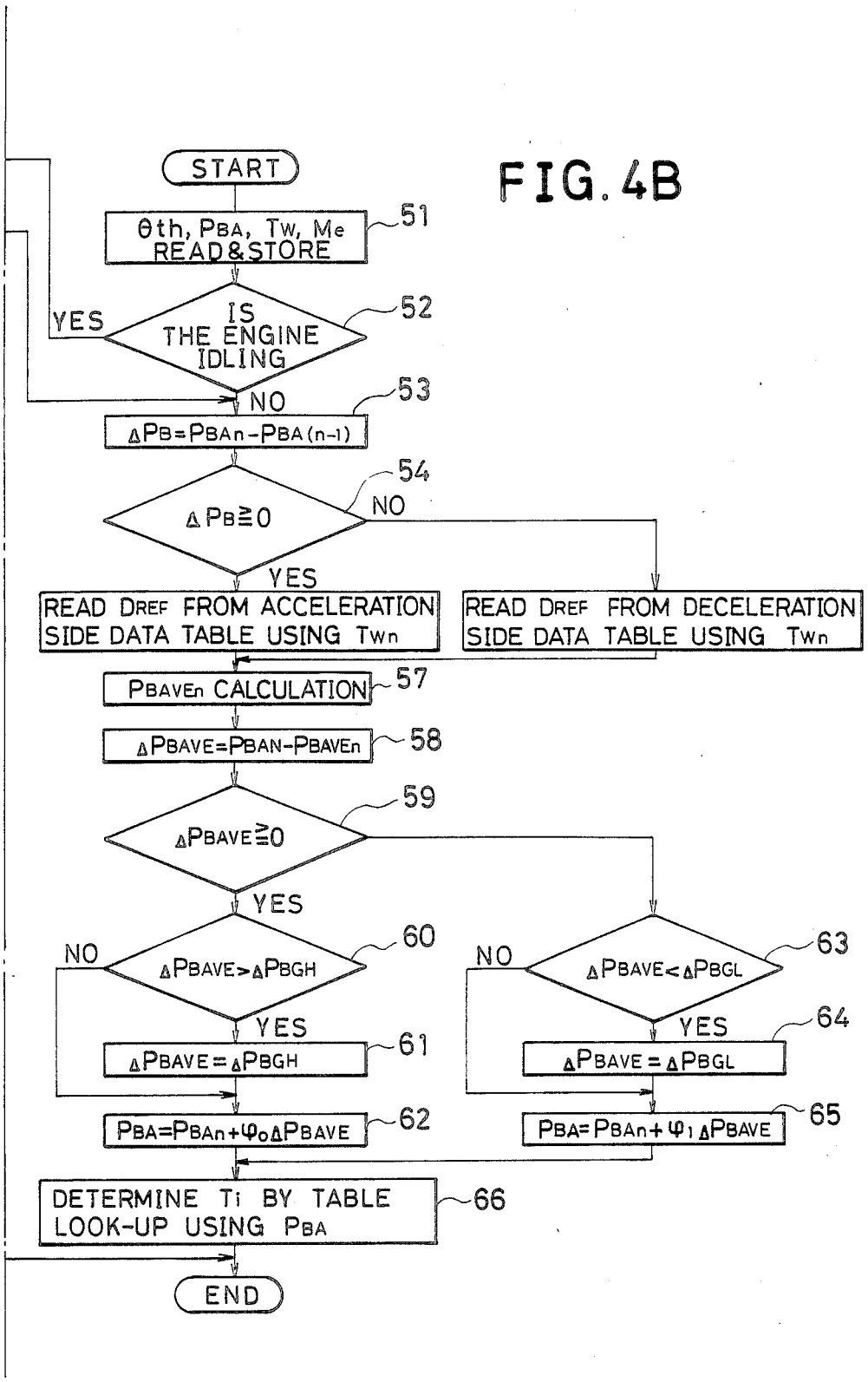

Each step of the operation of the method for controlling the supply of fuel according to the present invention, which is controlled by the control circuit 16, will be further explained with reference to the flowchart of FIGS. 4A and 4B.

In this sequential operations, the opening degree of the throttle valve $\theta_{th}$, the absolute value of the intake air pressure $P_{BA}$, the engine coolant temperature $T_W$, and the count value $M_e$ are read by the CPU 27 respectively as a sampled value $\theta_{thn}$, a sampled value $P_{BAn}$, a sampled value $T_{Wn}$, and a sampled value $M_{en}$, in synchronism with the occurence of every nth TDC signal. These sampled values $\theta_{thn}$, $P_{BAn}$, $T_{Wn}$, and $M_{en}$ are in turn stored in the RAM 29 at a step 51. The sampled value $M_{en}$ corresponds to the above mentioned period $A_n$. Subsequently, whether the engine 4 is operating under an idling state or not is detected at a step 52. Specifically, the idling state is detected in terms of the engine rpm $N_e$ derived from the count value $M_e$ and the absolute pressure of the intake air $P_{BA}$. More specifically, the operation of the engine 4 is determined to be idling when the engine rpm $N_{en}$ corresponding to the sampled value $M_{en}$ is equal to or lower than an idling reference engine rpm $N_{IDL}$ and at the same time the sampled value $P_{BAn}$ is equal to or smaller than an idling reference pressure level $P_{IDL}$.

Figure 5:
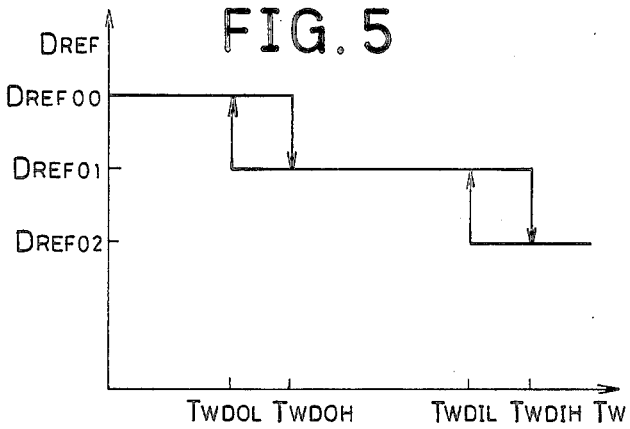
FIGS. 5 and 6 are characteristic diagrams showing the manner of setting of the constant $D_{REF}$ relative to the engine coolant temperature $T_W$.
Figure 6:
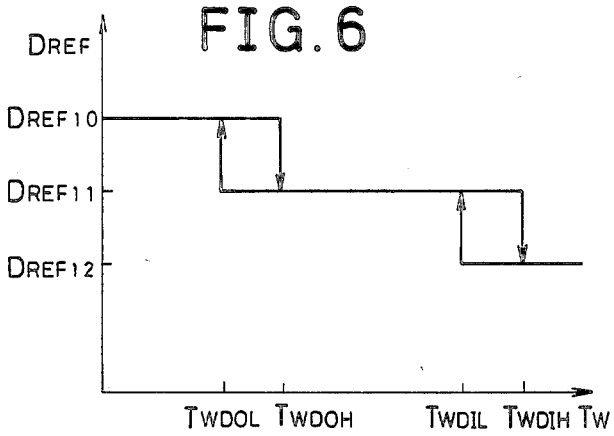

When the engine is not operating under the idling condition, a preceding sampled value $P_{BA(n-1)}$ of the absolute pressure $P_{BA}$ is read out from the RAM 29. Then a subtraction value $\Delta P_B$ between a latest sampled value $P_{BAn}$ and the preceding sampled value $P_{BAn-1}$ is calculated at a step 53. Subsequently, whether or not the subtraction value $\Delta P_B$ is equal to or greater than 0 is detected at a step 54. If $\Delta P_B > 0$, it is regarded that the engine is accelerating, and a constant $D_{REF}$ corresponding to the sampled value $T_{Wn}$ of the engine coolant temperature $T_W$ is read out from a data table of acceleration side which is previously stored in the ROM 28, at a step 55. The data table of acceleration side stored in the ROM 28 is made up of a plurality of data which together form a characteristic relative to the engine coolant temperature as shown in FIG. 5. Conversely, if $\Delta P_B<0$, it is regarded that the engine is decelerating, and the constant $D_{REF}$ corresponding to the sampled value $T_{Wn}$ of the engine coolant temperature $T_W$ is read out, in the similar manner as the step 55, from a data table of deceleration side which is previously stored in the ROM 28, at a step 56. The data table of deceleration side has a characteristic as shown in FIG. 6. The constant $D_{REF}$ is determined so that it is larger in the accelerating condition than in the decelerating condition, at the same level of the engine coolant temperature. The actual value of the constant $D_{REF}$ used in the CPU 27 is determined to be such a value satisfying a relation of $1 \leqq D_{REF} \leqq A-1$, where A is a constant. Along with the constant $D_{REF}$, the constant A is utilized in the calculation of the target value in accordance with an equation (1) described below. In the equation (1), the constant A determines the resolution of the calculated value. If the CPU 27 is of the eight bit type, the value of the constant A is set at 256. After setting the constant $D_{REF}$ in this way, a target value $P_{BAVE(n-1)}$ calculated by a previous calculation step using the equation (1) is read out from the RAM 29 and a target value $P_{BAVEn}$ of the present time is calculated using the equation (1) at a step 57.

$$P_{BAVEn}=(D_{REF}/A)P_{BAn}+\{(A-D_{REF})/A\}P_{BAVE(n-1)} \quad (1)$$

In the equation (1), the calculation of the target value is based in principle on the averaging of the sampled values $P_{BA1}$ through $P_{BAn}$ of the absolute value of the intake air pressure. Also, the loss of fuel due to the adhesion on an inner wall of the intake manifold is considered in the calculation of this target value $P_{BAVEn}$. Then, a subtraction value $\Delta P_{BAVE}$ between the sampled value $P_{BAn}$ and the thus calculated target value $P_{BAVEn}$ is calculated at a step 58. In turn, whether or not the subtraction value $P_{BAVE}$ is equal to or greater than 0 is detected at a step 59. If $P_{BAVE} \geqq 0$, it is regarded that the engine is accelerating and whether or not the subtraction value $\Delta P_{BAVE}$ is greater than an upper limit value $\Delta P_{BGH}$ is detected at a step 60. If $\Delta P_{BAVE}>\Delta P_{BGH}$, the subtraction value $\Delta P_{BAVE}$ is made equal to the upper limit value $\Delta P_{BGH}$ at a step 61. If, on the other hand, $\Delta P_{BAVE} \leqq \Delta P_{BGH}$, the subtraction value calculated at the step 58 is maintained as it is. Afterwards, the corrected value $P_{BA}$ of the sampled value $P_{BAn}$ is calculated at a step 62 by multiplying the subtraction value $\Delta P_{BAVE}$ by a correction coefficient $\phi_0$, and adding the sampled value $P_{BAn}$ to the multiplied value.

If, on the other hand, $\Delta P_{BAVE}<0$ at the step 59, it is regarded that the engine is decelerating, and whether or not the subtraction value $\Delta P_{BAVE}$ is smaller than a lower limit value $\Delta P_{BGL}$ is detected at a step 63. If $\Delta P_{BAVE}<\Delta P_{BGL}$, the subtraction value $\Delta P_{BAVE}$ is made equal to the lower limit value $\Delta P_{BGL}$ at a step 64. If $\Delta P_{BAVE} \geqq \Delta P_{BGL}$, the subtraction value $\Delta P_{BAVE}$ obtained at the step 58 is maintained as it is. Afterwards, the corrected value $P_{BA}$ of the sampled value $P_{BAn}$ is calculated at a step 65 in the similar manner as the step 62, by multiplying the subtraction value $\Delta P_{BAVE}$ by a correction coefficient $\phi_1$ ($\phi_1>\phi_0$), and adding the sampled value $P_{BAn}$ to the multiplied value.

After calculating the corrected value in this way, a basic fuel injection time $T_i$ is determined using a data table previously stored in the ROM 28, in accordance with the corrected value $P_{BA}$ and the sampled value $M_{en}$ of the count value $M_e$ at a step 66. This basic fuel injection time Ti is further corrected in accordance with other engine operating parameters, to derive a fuel injection time $T_{OUT}$ corresponding to a first fuel supply amount.

If, on the other hand, the engine is detected to be idling at the step 52, whether or not the latest sampled value $\theta_{thn}$ of the opening degree of the throttle valve $\theta_{th}$ is greater than an idling reference throttle opening value $\theta_{IDL}$ is detected at a step 67. If $\theta_{thn}>\theta_{IDL}$, it is regarded that the idling of the engine is not required and the program goes to the step 53. If $\theta_{thn} \leqq \theta_{IDL}$, whether or not a predetermined time period $t_{IDL}$ has passed after satisfying the condition of $\theta_{thn} \leqq \theta_{IDL}$ is detected at a step 68. In this detection step, a timer counter which counts down from a predetermined initial value corresponding to the time period $t_{IDL}$ each time of execution of the step 68, is utilized and it is determined that the predetermined time period $t_{IDL}$ has passed when the count value reaches "0". In addition, this timer counter is adapted to be reset to the initial value when $\theta_{thn}>\theta_{IDL}$ at the step 67. The predetermined time period $t_{IDL}$ is such a time period in which the engine rpm reaches a stable level from a point of time at which the requirement of idling operation of the engine is detected, by means of the opening degree of the throttle valve, at the step 67. In the case of internal combustion engines for a vehicle, this time period varies depending on the type of transmission, i.e., automatic transmissions (AT) and manual transmissions (MT), and also depending on the state of operation of the transmission, i.e. the gear is engaged or in the neutral position. Therefore, this time period is set to be slightly longer than a longest period estimated. If the result of detection is that this time period $t_{IDL}$ has not passed, it is regarded that the engine rpm is not stabilized and the program goes to the step 53 regardless of the engine operation in the idling state. When it is detected that the time period $t_{IDL}$ has passed, a preceding target value $M_{eAVE(n-1)}$ which was calculated at a previous calculation cycle using an equation (2) described below is read out from the RAM 29.

$$M_{eAVEn}=(M_{REF}/A)M_{en}+\{(A-M_{REF})/A\}M_{eave(n-1)} \quad (2)$$

At the same time, a target value $M_{eAVEn}$ is calculated using the equation (2) according to the constant A and a constant $M_{REF}$ ($1 \leqq M_{REF} \leqq A-1$), at a step 69. In the equation (2), the calculation of the target value $M_{eAVEn}$ is principally based on the calculation of the average value of the sampled values $M_{en}$ of the count values.

A subtraction value $\Delta M_{eAVE}$ between the latest sampled value $M_{en}$ of the counted value $M_e$ and the thus derived target value $M_{eAVEn}$ is then calculated at a step 70. Whether or not the subtraction value $\Delta M_{eAVE}$ is smaller than 0 is detected at a step 71. If $\Delta M_{eAVE} \geqq 0$, it is regarded that the actual engine rpm is lower than a target engine rpm corresponding to the target value $M_{eAVEn}$, and a correction time period $T_{IC}$ is calculated at a step 72 by multiplying the subtraction value $\Delta M_{eAVE}$ by a correction coefficient $\alpha_1$. Then whether or not the correction time period $T_{IC}$ is greater than an upper limit time period $T_{GH}$ is detected at a step 73. If $T_{IC} > T_{GH}$, it is regarded that the correction time period $T_{IC}$ calculated at the step 72 is too long, and the correction time period $T_{IC}$ is made equal to the upper limit time period $T_{GH}$ at a step 74. If $T_{IC} \leqq T_{GH}$, the correction time period $T_{IC}$ at the step 72 is maintained as it is. If, on the other hand, it is detected that $\Delta M_{eAVE} < 0$ at the step 71, it is regarded that the actual engine rpm is higher than the target engine rpm corresponding to the target value $M_{eaVEn}$, and the correction time period $T_{IC}$ is calculated, at a step 75, by multiplying the subtraction value $\Delta M_{eAVE}$ by a correction coefficient $\alpha_2$ ($\alpha_2 > \alpha_1$). Then, whether or not the correction time period $T_{IC}$ is shorter than a lower limit time period $T_{GL}$ is detected at a step 76. If $T_{IC} < T_{GL}$, it is regarded that the correction time period $T_{IC}$ calculated at the step 75 is too short, and the correction time period $T_{IC}$ is made equal to the lower limit time period $T_{GL}$ at a step 77. If $T_{IC} \geqq T_{GL}$, the correction time period $T_{IC}$ at the step 75 is maintained as it is. After setting the correction time period $T_{IC}$ in this way, the basic fuel injection time is read out from the fuel injecton time data table stored in the ROM 28 using the latest sampled values $P_{BAn}$ and $M_{en}$. Then, the basic fuel injection time is corrected by various parameters so that a fuel injection time $T_{OUTM}$ is derived. Then the fuel injection time $T_{OUT}$ which corresponds to a second fuel supply amount is calculated by adding the correction time period $T_{IC}$ to the fuel injection time $T_{OUTM}$, at a step 78.

Thus, in the method for controlling the fuel supply according to the present invention, even though the engine operation is in the idling state, the engine operation is regarded to be out of the idling state for a predetermined time period $t_{IDL}$ after the start of the idling operation within which the engine operation is estimated to become stable idling condition where the engine rpm is stabilized. Under this condition, the first fuel supply amount is derived on the basis of the latest target value $P_{BAVEn}$, and the fuel is supplied to the engine in accordance with the thus determined first fuel supply amount. After the elapse of the predetermined time period tIDL, the second fuel supply amount is determined on the basis of the estimated value of the engine rpm, that is, the latest target value $M_{eAVEn}$, and the fuel is supplied to the engine in accordance with the thus determined second fuel supply amount. In this way, the method for calculating the fuel supply amount is switched only when the engine operation has reached the stable idling condition even in the range of idling operation. Thus, the change in the amount of fuel at the time of the switching from the first fuel supply amount to the second fuel supply amount is made very small. This means the change in the engine rpm can be minimized. Further, in the event that the difference between the first fuel supply amount and the second fuel supply amount at the time of the entrance of the engine operation into the idling range is equal to the corresponding difference in the stable idling state, the difference of the engine torque is much smaller in the stable idling state since the engine torque decreases at the beginning of the idling state. Thus, the shock due to the change in the engine rpm becomes very small. Especially, in the case of vehicles with manual transmission, the transmission of engine power is interrupted during the stable idling state even though the transmission of engine power is made at the time of starting of the idling condition. Thus, the shock to the driver or passenger of the vehicle at the time of switching of the method of calculation is made very small.

What is claimed is:

1. A method for controlling fuel supply of an internal combustion engine, according to a pressure within an intake pipe downstream of a throttle valve and an engine rotational speed, comprising steps of:

detecting an instant at which an angular position of a crankshaft of the engine becomes equal to a predetermined angular position, repeatedly;

sampling said pressure within the intake pipe downstream of the throttle valve and an engine rotational speed each time of detection of said instant;

detecting whether the engine is operating within an idling range using a latest sampled value $P_{BAn}$ of said pressure within the intake pipe and a latest sampled value $M_{en}$ of said engine rotational speed;

setting a target value $P_{BAVEn}$ having a predetermined functional relation with said latest sampled value $P_{BAn}$ of pressure within the intake pipe and a preceding target value $P_{BAVE(n-1)}$ determining a first fuel supply amount according to said target value $P_{BAVEn}$ when the engine is detected to be operating outside of said idling range, and during a predetermined time period from a time when the engine is detected firstly to be operating within said idling range;

setting a target value $M_{eAVEn}$ having a predetermined functional relation with said latest sampled value $M_{en}$ of the engine rotational speed and a preceding target value $M_{eAVE(n-1)}$, and determining a second fuel supply amount according to said target value $M_{eAVEn}$ when the engine is detected to be operating within said idling range for more than the predetermined time period; and supplying fuel to the engine according to one of said first and second fuel supply amounts which are determined alternatively.

2. A method as claimed in claim 1, wherein said idling range is a range in which the engine rotational speed is not higher than an idling reference engine speed determined to be slightly higher than a stable engine speed obtained when warming up of the engine is completed and no load is applied to the engine, and the pressure within the intake pipe is not higher than an idle reference pressure determined to be slightly higher than a level of the pressure within the intake pipe observed when engine is operating at said stable engine speed.

3. A method as claimed in claim 1, wherein said target value $P_{BAVEn}$ is calculated by an equation:

$$P_{BAVEn} = (D_{REF}/A)P_{BAn} + \{(A - D_{REF})/A\}P_{BAVE(n-1)}$$

ps in which A is a constant, and $D_{REF}$ satisfying a condition of 1 $D_{REF} \leqq A - 1$ is a constant which determines a degree of contribution of an average value of sampled values $P_{BAn}$ of the pressure in the intake pipe up to a latest calculation.

4. A method as claimed in claim 3, wherein said first fuel supply amount is determined by calculating a subtraction value $P_{BAVE}$ between said latest sampled value $P_{BAn}$ and said target value $P_{BAVEn}$, multiplying said subtraction value $\Delta P_{BAVE}$ with a constant $\phi$, and adding said latest sampled value $P_{BAn}$ to a multiplied value.

5. A method as claimed in claim 1, wherein said target value is determined by an equation:

$$M_{eAVEn}=(M_{REF}/A)M_{en}+\{(A-M_{REF})/A\}M_{eAVE(n-1)}$$

in which A is a constant and $M_{REF}$ satisfying a condition of $1 \leqq M_{REF} \leqq A-1$ is a constant determining a degree of contribution of an average value of sampled values $M_{en}$ of the engine rotational speed up to a latest calculation.

6. A method as claimed in claim 5, wherein said second fuel supply amount is determined by calculating a subtraction value $\Delta M_{eAVE}$ between said latest sampled value $M_{en}$ and said target value $M_{eAVEn}$, and multiplying said subtraction value with a constant $\alpha$.

* * * * *